US006109674A

United States Patent [19]

Bartel et al.

[11] Patent Number: 6,109,674

[45] Date of Patent: Aug. 29, 2000

[54] POWER-ACTUATED MOTOR-VEHICLE DOOR LATCH WITH PLASTIC HOUSING

[75] Inventors: Peter Bartel, Hattingen; Rainer Haubs, Dinslaken, both of Germany

[73] Assignee: Kiekert AG, Heiligenhaus, Germany

[21] Appl. No.: 09/001,244

[22] Filed: Dec. 30, 1997

[30] Foreign Application Priority Data

Jan. 23, 1997 [DE] Germany ..... 197 02 205

[51] Int. Cl.[7] ..... E05B 9/00

[52] U.S. Cl. ..... 292/337; 292/216; 292/201; 292/DIG. 23; 292/DIG. 38

[58] Field of Search ..... 292/337, 216, 292/DIG. 23, DIG. 38, 201; 70/262, 263, 264

[56] References Cited

U.S. PATENT DOCUMENTS

| | | | |
|---|---|---|---|
| 4,806,712 | 2/1989 | Hoffman et al. | 200/61.62 |
| 4,904,006 | 2/1990 | Hayakawa et al. | 292/216 |
| 5,267,090 | 11/1993 | Dowd et al. | 359/838 |
| 5,516,167 | 5/1996 | Hayakawa et al. | 292/337 |
| 5,520,424 | 5/1996 | Hapke et al. | 292/337 |
| 5,564,308 | 10/1996 | Hoshikawa et al. | 292/201 |
| 5,678,869 | 10/1997 | Yoshikuwa | 292/337 |
| 5,746,076 | 5/1998 | Inoue | 292/201 |

FOREIGN PATENT DOCUMENTS 196 22 028 12/1996 Germany .

*Primary Examiner*—B. Dayoan
*Assistant Examiner*—Clifford B Vaterlaus
*Attorney, Agent, or Firm*—Herbert Dubno; Andrew Wilford

[57] ABSTRACT

A motor-vehicle door latch has a metallic mounting plate, latching elements mounted on the plate and operable to secure a door carrying the latch in a closed position, a latch mechanism connected to the elements for operating same, and a plastic housing. The housing has a part fixed to the metallic mounting plate and a cover surrounding the mechanism and elements and formed with a plurality of mounting pockets. A plurality of conductors imbedded in the cover have exposed ends at least some of which are exposed in each of the pockets. An electrical drive unit fixed in one of the pockets of the housing is connected to the exposed ends in the respective pocket and is connected to the mechanism. At least one switch operable by the mechanism is mounted in another of the pockets and connected to the exposed ends in the respective pocket.

4 Claims, 6 Drawing Sheets

POWER-ACTUATED MOTOR-VEHICLE DOOR LATCH WITH PLASTIC HOUSING

FIELD OF THE INVENTION

The present invention relates to a motor-vehicle door latch. More particularly this invention concerns such a latch holding a motor or other actuator for operation of the latch by a central-locking and/or antitheft system.

BACKGROUND OF THE INVENTION

A standard motor-vehicle door latch has a rigid housing that is normally mounted on a door edge and in which are mounted locking elements including a pivotal lock fork that can engage around and retain a bolt or wedge carried on a door post and a retaining pawl that is also pivoted on the housing and that can retain or release the fork. In addition the housing contains an actuating and locking mechanism typically formed by various levers that are connected to inside and outside handles and inside and outside locking elements for operation of the retaining pawl in a manner well known in the art.

It is also standard to provide such a latch with a drive unit constituted by an electric motor and transmission that can move the elements of the latch between locked and unlocked positions, and even often into an antitheft position. In the locked and antitheft positions the outside door handle is decoupled from the latch mechanism. In the locked position the inside locking element is normally still operational, or the door can be unlocked by a double actuation of the inside handle. In the antitheft position the inside handle is deactivated so the only way to unlock the door is by use of a key.

Such a power-actuated latch also normally has various switches that are connected to the central locking system and to appropriate warning lights to inform the locking system and driver of the status of the lock, whether it is in the locked, unlocked, or antitheft position, and whether the door is fully latched or not. Hence it is standard to provide a plug on the side of the lock to which is connected one end of a multiconductor cable leading to the central lock system and dashboard and to the vehicle power supply. The plug has a plurality of terminals each connected to one end of an insulated wire whose other end is connected to a respective terminal on a switch, sensor, or motor.

This wiring is fairly difficult and, hence, expensive to install in the latch during its manufacture. It must be meticulously routed through the latch to keep out of the way of the various moving parts of the latch. Furthermore in use the latch is subjected to substantial dynamic forces. When the door is slammed, for instance, all the parts of the latch, including the wiring, are subjected to considerable stress. Simple vibration alone, which such a latch is also subjected to constantly during travel, can cause the wiring to work at its connections and eventually fail and come loose. A motor-vehicle door latch is known having a composite housing having walls forming a generally closed interior and formed of a plastic body forming at least one of the walls and a metallic reinforcing plate imbedded in the plastic body. Latch elements—normally a pivotal fork and retaining pawl—in the interior are pivoted on the reinforcing plate. Electrical circuit components having connection terminals are mounted on the housing in the interior and an assembly of contacts is mounted on the housing accessible from outside the housing. Respective conductors imbedded in the plastic body each have one end connected to a respective one of the contacts and an opposite end each provided with a respective connection formation joined to a respective one of the terminals.

Thus this system eliminates the use of free-running wires. The conductors are imbedded in the plastic body of the housing so that their paths and positions are perfectly controlled and stabilized. They therefore are not subject to damage in manufacture or use. Such conductors can easily be set with the metal plate in the mold used to make the housing so that they are fixed in place once the resin is injected into the mold and cured.

While this system is relatively effective, it could be better integrated with respect to the connections of the various parts and how the mechanical and electrical elements fit in the housing. In particular the conductors are imbedded in housing parts that are used for support of mechanical elements so that manufacture is difficult, especially when aiming at making the latch as compact as possible.

OBJECTS OF THE INVENTION

It is therefore an object of the present invention to provide an improved motor-vehicle door latch.

Another object is the provision of such an improved motor-vehicle door latch which overcomes the above-given disadvantages, that is whose electrical and mechanical elements are integrated into a housing that interconnects and holds them in such a manner that a long service life is insured and manufacture is easy.

SUMMARY OF THE INVENTION

A motor-vehicle door latch has according to the invention a metallic mounting plate, latching elements mounted on the plate and operable to secure a door carrying the latch in a closed position, a latch mechanism connected to the elements for operating same, and a plastic housing. The housing has a part fixed to the metallic mounting plate and a cover surrounding the mechanism and elements and formed with a plurality of mounting pockets. A plurality of conductors imbedded in the cover have exposed ends at least some of which are exposed in each of the pockets. An electrical drive unit fixed in one of the pockets of the housing is connected to the exposed ends in the respective pocket and is connected to the mechanism. At least one switch operable by the mechanism is mounted in another of the pockets and connected to the exposed ends in the respective pocket.

Thus according to the invention the mechanical and electrical elements are separated from each other. The electrical elements, including the wiring, the drive unit, and the switches, are all mounted in the plastic cover with the wiring being formed by conductors imbedded in this cover. A tree of the wiring is simply put in the mold used to form the cover so that the conductors are completely insulated and protected while taking up no useful space. The ends of the wiring tree are fitted to holders that during molding ensure proper positioning of the tree and that are pulled out after the molded cover has cured somewhat to leave these ends exposed.

On the other hand the mechanical elements—the latch fork, retaining pawl, and their pivots—are mounted on the metal mounting plate that is normally fixed to or even partly imbedded in the other plastic part that together with the cover forms the plastic housing. With this system fitting the cover to the other housing part couples the motor drive unit to the latch mechanism while positioning the switches to coact with this mechanism.

According to the invention the exposed ends of the mounting pockets are formed as connector prongs engageable in the drive unit and switch. Thus the drive unit and switch are provided with sockets that fit with these connector prongs when they are installed, making assembly very simple.

The drive unit in accordance with the invention comprises a mounting plate, a motor carried on one side of the plate, and an output element connected to the motor and exposed on an opposite side of the plate. The mounting plate closes the pocket containing the drive unit, protecting it.

The pockets holding the switches are provided according to the invention with formations that complementarily snap together with the respective switches. In addition the latch mechanism includes an inside locking lever and inside actuating lever pivoted on the cover.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
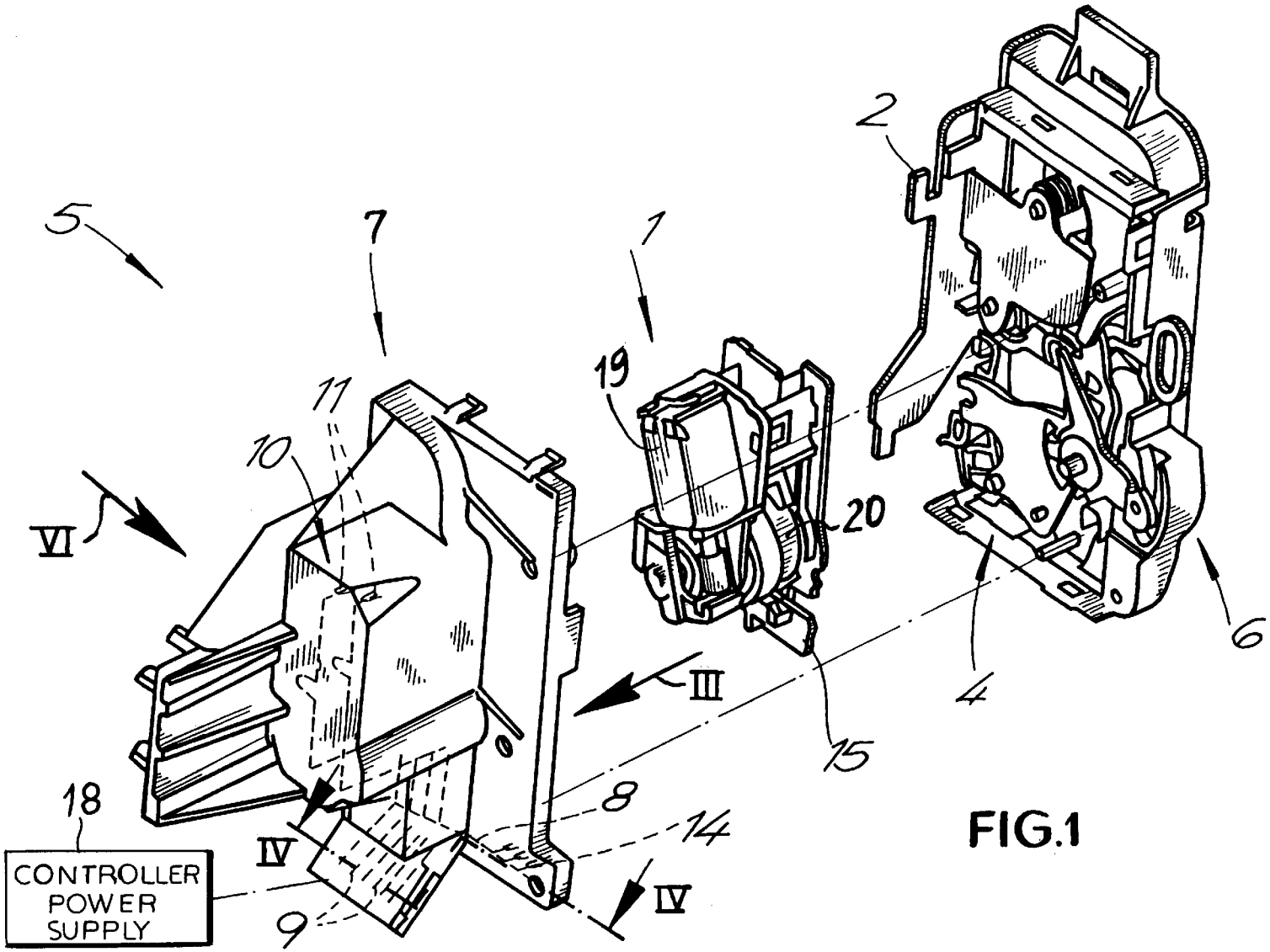
FIG. 1 is a perspective exploded view of the latch according to the invention.
Figure 2:
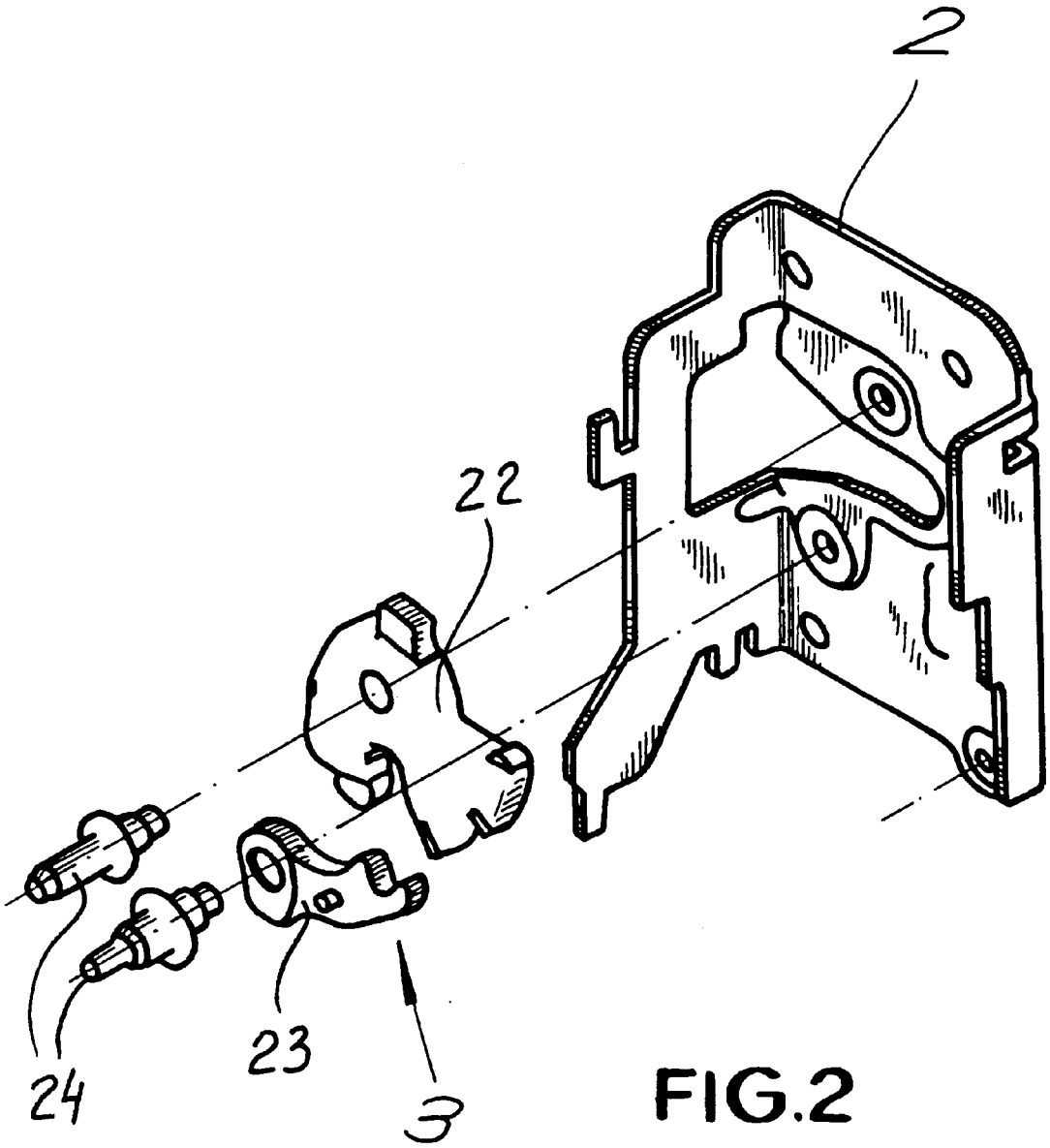
FIG. 2 is a perspective exploded view of the lock plate and associated latch elements.

As seen in FIG. 1 a latch according to the invention for a motor vehicle with a central-locking system having antitheft features has a motor drive unit 1, a metallic latch plate 2, latching elements 3 (FIG. 2), latch-actuating mechanism 4, and a plastic housing 5. The latching elements 3 are metallic and include a pivotal fork 22 and a retaining pawl 23 mounted on two steel pivots 24 seated in the plate 2. The mechanism 4 includes an inside locking lever 16 (FIG. 6) and an inside actuating lever 17 and may also include other levers that operate the pawl 23 from unillustrated door handles while allowing these handles to be decoupled from the latch elements 3 when unillustrated locking elements, for instance an outside key cylinder or inside button, are operated to lock the door.

Figure 4:
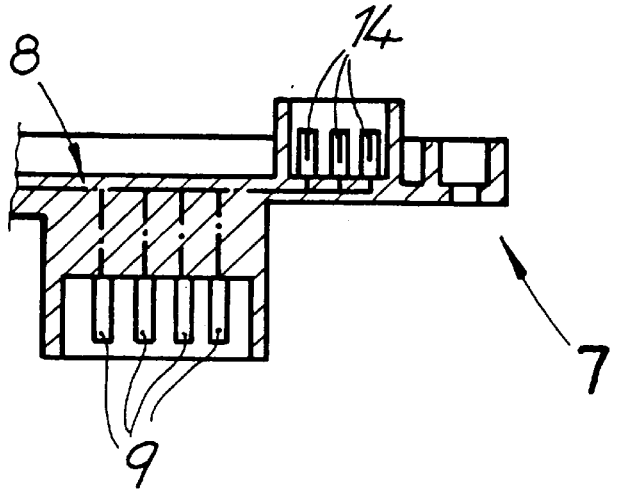
FIG. 4 is a section taken along line IV—IV of FIG. 1.
Figure 5:
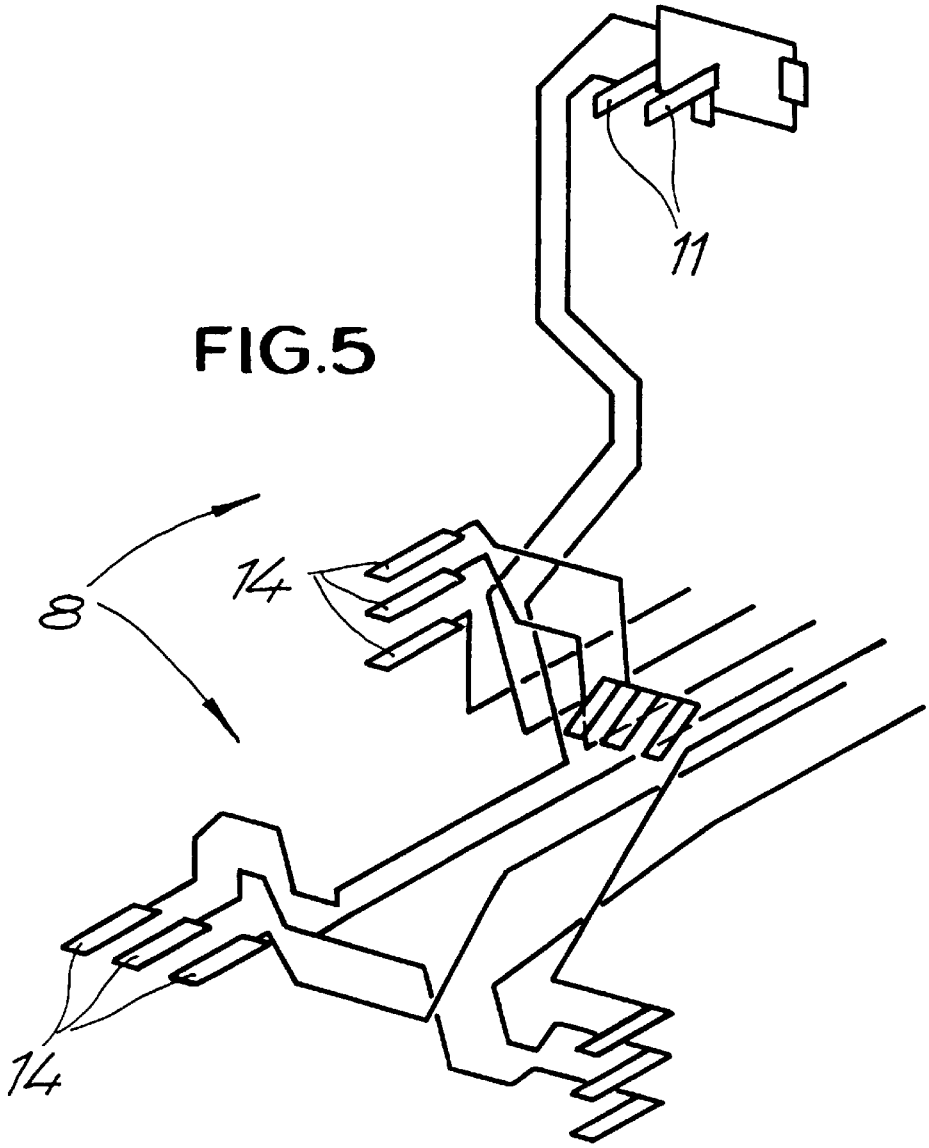
FIG. 5 is a perspective view illustrating the conductors of this invention.
Figure 6:
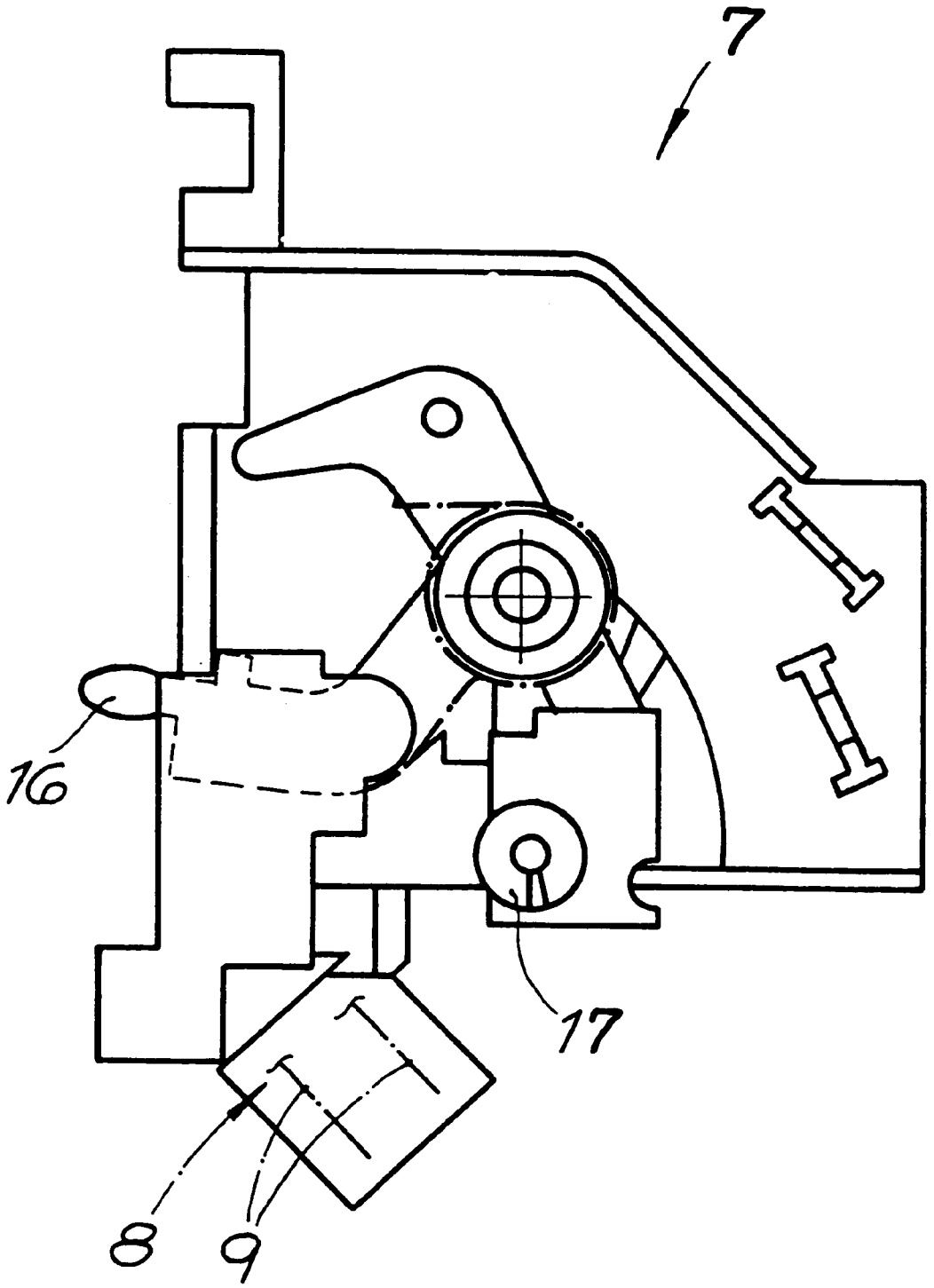
FIG. 6 is a side view taken in the direction of arrow VI of FIG. 1.

The housing 5 comprises a base plate 6 fixed to the plate 2 and a cover 7. Electrical conductors 8 are imbedded in the dielectric plastic of the cover 7 and have as shown in FIG. 4 exposed ends formed as contacts 9 and 14 which are fairly stiff so they can mate effectively with appropriate plugs or contacts. In addition the levers 16 and 17 are mounted on the cover 7 as shown in FIG. 6.

Figure 3:
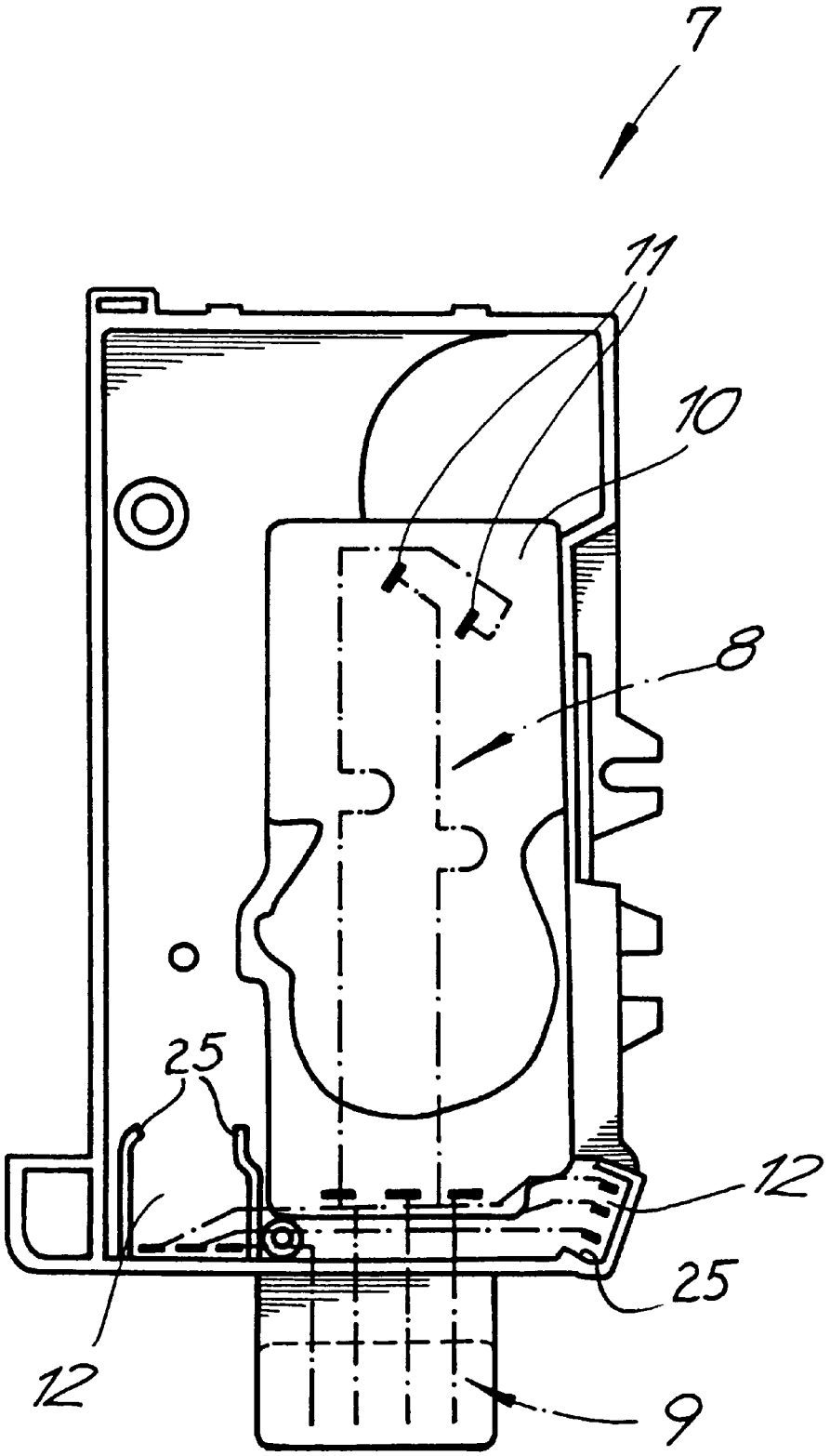
FIG. 3 is a view taken in the direction of arrow III of FIG. 1.

In addition as shown in FIG. 3 the cover 7 is formed with a pocket 10 into which the drive unit 1 fits complementarily and contacts 11 formed on the conductors 8 engage similar such contacts in the drive unit 1 to feed it power from a controller/power supply shown schematically at 18 in FIG. 1. The drive unit 1 comprises a motor 19 and transmission 20 both mounted on a plate 15 that hermetically closes the pocket 10, with output elements 21 (FIG. 7) of the drive unit 1 being exposed on the plate 15 for interaction with the latch mechanism 4.

Figure 7:
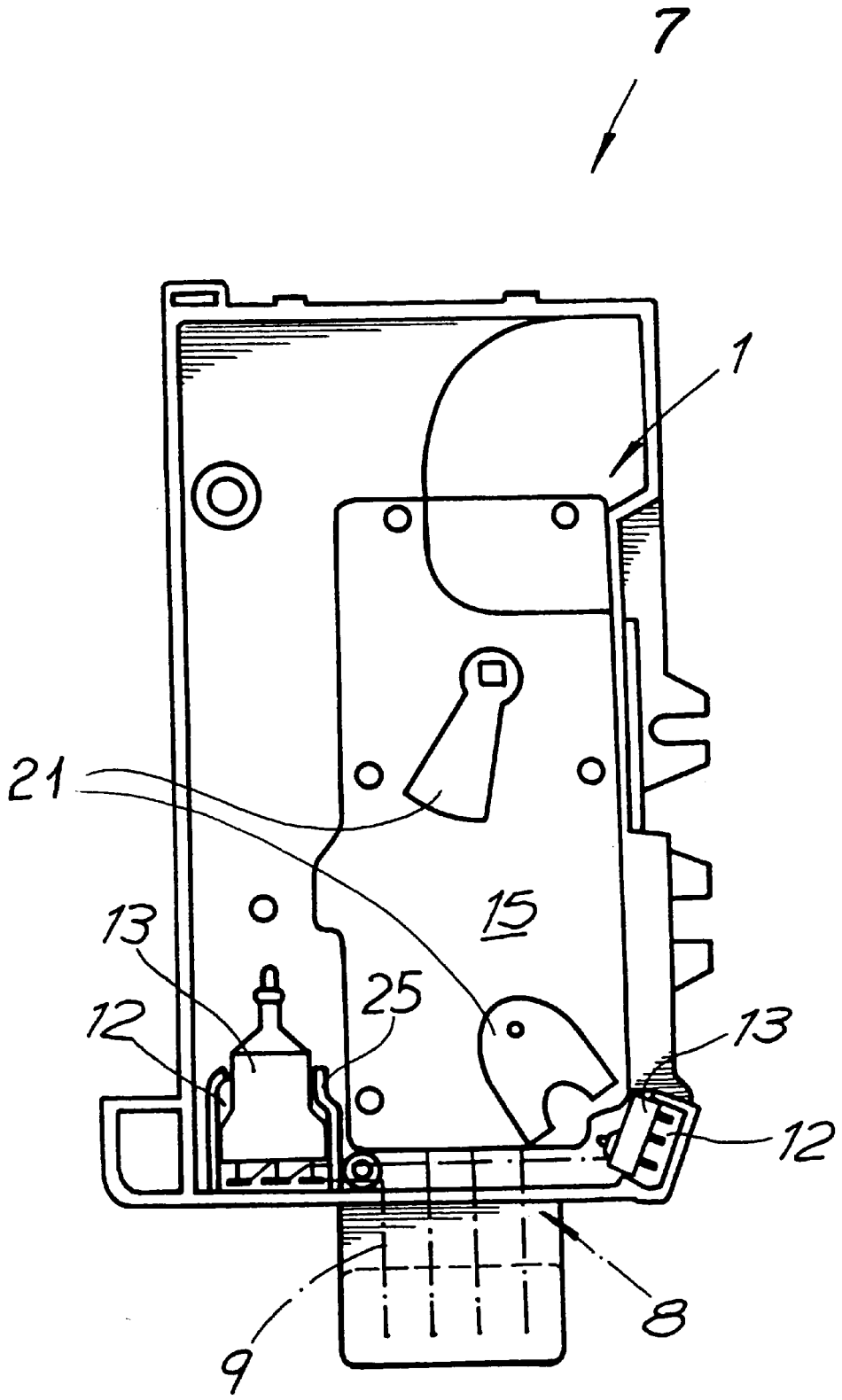
FIG. 7 is a view like FIG. 3 but showing the drive unit installed.

In addition the plastic cover 7 is formed with seats or sockets 12 in which contacts 9 are exposed and which are shaped to snugly hold switches 13 as shown in FIG. 7. These switches 13 provide outputs to the controller 18 so it can monitor the condition of the door latch. Formations 25 in the pockets 12 snap fit with the switches 13 to hold them in place.

Thus with this system all the mechanical parts—the latching elements 3 and mechanism 4—are carried on the plate 2 while the electrical elements—the drive unit 1, conductors 8, and switches 13—are carried on the plastic cover 7. These conductors 8 are imbedded in the plastic of the cover where they are completely out of harm's way.

We claim:

1. A motor-vehicle door latch comprising:

a first metallic mounting plate;

latching elements mounted on the first mounting plate and operable to secure a door carrying the latch in a closed position;

a plastic housing having a part fixed to the first metallic mounting plate and a cover surrounding the elements, the cover being formed with a plurality of mounting pockets;

a latch mechanism including an externally operable inside locking lever and an externally operable inside actuating lever connected to the elements for operating same and both pivoted on the cover on a side of one of the pockets;

a plurality of conductors having ends, imbedded in the cover, and exposed only at the ends, at least some of the ends being exposed in each of the pockets;

a second metallic mounting plate fixed in the one pocket;

an electrical drive unit mounted on the second metallic mounting plate, connected to the exposed ends in the one pocket, and connected to the mechanism; and a switch operable by the mechanism, mounted in another of the pockets, and connected to the exposed ends in the other pocket.

2. The motor-vehicle door latch defined in claim 1 wherein the exposed ends in the mounting pockets are formed as connector prongs engageable in the drive unit and switch.

3. The motor-vehicle door latch defined in claim 1 wherein the drive unit further comprises a motor carried on one side of the second mounting plate, and an output element connected to the motor and exposed on an opposite side of the second mounting plate, the second mounting plate closing the one pocket containing the drive unit.

4. The motor-vehicle door latch defined in claim 1 wherein the pocket holding the switch is provided with formations that complementarily snap together with the switch.

* * * * *